United States Patent [19]

Thomas

[11] Patent Number: 4,583,389

[45] Date of Patent: Apr. 22, 1986

[54] METHOD FOR REMOVING CERTAIN OF THE CORRUGATIONS IN A HELICALLY CORRUGATED PIPE

[75] Inventor: Albert M. Thomas, North Canton, Ohio

[73] Assignee: LTV Steel, Cleveland, Ohio

[21] Appl. No.: 148,133

[22] Filed: May 9, 1980

Related U.S. Application Data

[62] Division of Ser. No. 937,429, Aug. 28, 1978, abandoned.

[51] Int. Cl.[4] ..... B21D 41/04; B21D 41/02

[52] U.S. Cl. ..... 72/402; 72/370; 72/399; 138/122

[58] Field of Search ..... 72/399, 402, 400, 370; 138/173, 122; 113/116 UT; 285/DIG. 4

[56] References Cited

U.S. PATENT DOCUMENTS

| | | | |
|---|---|---|---|
| 63,077 | 3/1867 | Montgomery | 138/173 |
| 85,149 | 12/1868 | Van Amringe | 138/173 |
| 650,575 | 5/1900 | Whitney | 138/173 |
| 852,478 | 5/1907 | Voris | 138/173 |
| 919,997 | 4/1909 | Zelch | 285/DIG. 4 |
| 942,466 | 12/1909 | Schnuerer | 138/173 |
| 1,049,542 | 1/1913 | Smith | 138/173 |
| 1,819,175 | 8/1931 | James | 138/122 |
| 1,864,861 | 6/1932 | Schaller | 138/122 |
| 2,225,345 | 12/1940 | Lamoreaux | 72/402 |
| 2,349,037 | 5/1944 | Gibbs | 72/399 |
| 2,898,941 | 8/1959 | Kilcup | 138/122 |
| 3,188,586 | 6/1965 | Martin et al. | 138/122 |
| 3,273,916 | 9/1966 | Tillery | 138/122 |
| 3,338,082 | 8/1967 | Steele et al. | 72/306 |
| 3,470,724 | 10/1969 | Gregg | 72/306 |
| 3,708,867 | 1/1973 | Meserole | 113/116 UT |
| 3,743,328 | 7/1973 | Longfellow | 138/122 |
| 3,779,312 | 12/1973 | Withers, Jr. et al. | 138/122 |
| 3,926,222 | 12/1975 | Shroy et al. | 138/122 |
| 4,044,581 | 8/1977 | Meserole | 72/367 |
| 4,252,473 | 2/1981 | Thomas et al. | 405/250 |

FOREIGN PATENT DOCUMENTS

| | | | |
|---|---|---|---|
| 2610297 | 9/1977 | Fed. Rep. of Germany | 285/DIG. 4 |

*Primary Examiner*—Daniel C. Crane

*Attorney, Agent, or Firm*—Watts, Hoffmann, Fisher & Heinke Co.

[57] ABSTRACT

Corrugations are removed from the end of a helically corrugated pipe by compressing the end of the pipe between a plurality of radially movable die segments. By choosing appropriately-shaped die segments and die-actuating cams, the end of the pipe can be expanded, or shrunk to a diameter less than that of an imaginary cylinder defined by a surface of revolution contacting the innermost surfaces of the pipe. Products manufactured in accordance with the method of the invention have an end portion with an accurately controlled diameter; a minimum of pipe length is taken up by the modification.

11 Claims, 7 Drawing Figures

METHOD FOR REMOVING CERTAIN OF THE CORRUGATIONS IN A HELICALLY CORRUGATED PIPE

This is a division, of appliation Ser. No. 937,429 filed Aug. 28, 1978, now abandoned.

BACKGROUND OF THE INVENTION

1. Field of the Invention

The invention relates to techniques for removing corrugations from the ends of helically corrugated pipe and to products produced by such techniques.

2. Description of the Prior Art

Corrugated pipe is used in a wide variety of applications such as conduits for conveying water, piles for supporting buildings, and so forth. In particular, helically corrugated pipe often is preferred because it is stronger than annularly corrugated pipe. As used here, helically corrugated pipe refers to an elongate, tubular member having corrugations helically disposed with respect to a longitudinal axis of the member; annularly corrugated pipe refers to such a member having corrugations lying in a plane perpendicular to a longitudinal axis of the member.

Frequently, it is desirable to join sections of corrugated pipe end-to-end to form an elongated conduit or other structure. One technique for forming an elongated conduit is to join the sections telescopically so that an end of one pipe is nested within an end of another pipe. Accordingly, by making the ends of a given pipe section of slightly different diameters, this joining process can be used to connect any number of pipe sections. A significant advantage of the telescopic method of joining pipe sections is that specially configured connectors generally are not needed or are greatly simplified, and the pipe sections can be sealed and secured with a minimum of sealant and fasteners.

It is apparent that the ends of the pipe sections must be modified from their originally corrugated form if the pipe sections are to be joined telescopically. Although it is known to provide annularly corrugated pipe sections having straight end portions of different diameters, there presently is no known technique (other than this invention) for straightening the ends of helically corrugated pipe to produce straight ends which can be telescoped together.

Various attempts have been made to produce acceptable helical pipe connections, but it is believed that none have been entirely satisfactory. For example, it is known to rotate the ends of helically corrugated pipe between rollers to provide a plurality of annular corrugations at each end, and then to couple ends of successie pipe sections by means of a ring connector joining the abutting, annularly corrugated end portions. Although pipe sections joined by this technique are strong enough and seal satisfactorily, separate connectors must be procured and this increases the expense of the assembly.

Another proposed technique involves rolling the ends of helically corrugated sheet metal ducts between knurled rollers to produce at one end a straightened, knurled end portion, and at the other end a knurled end portion which subsequently is tapered by a crimping operation. This technique may be acceptable for joining sheet metal ducts (about 22–28 gage) especially if they are, as much ducting now is, aluminum. The technique is unacceptable for joining corrugated steel pipe (about 8–16 gage) because, among other reasons, such relatively thick steel is not susceptible to crimping.

Yet another proposed technique involves deforming an end of helically corrugated ducting between rollers to produce a tapered end portion having square-form threads. The modified end portion can be screwed directly into the unmodified end of another duct section. Although it is believed that this technique might function effectively to join aluminum sheet metal ducts, it is believed inacceptable for heavier-gage steel material because, among other reasons, such threads could not be found effectively.

In both approaches in which a tapered end portion is formed, it is difficult to maintain the orientation between the duct and the rollers during the rolling operation, with the result that the reworked end portion may not have an accurately controlled diameter. Consequently, it may be difficult to seal connected duct sections, and the modified end of the duct could be weaker in certain places than desired.

SUMMARY OF THE INVENTION

The present invention provides a new and improved technique for modifying the ends of helically corrugated pipe to produce end portions of accurately controlled diameter, and with a minimum of pipe length taken up by the modification. Essentially, the method according to the invention includes the step of compressing one end of a helically corrugated pipe between radially movable segments of annular dies to remove the corrugations in that portion of the pipe. If pipe sections are to be joined telescopically, both ends of each pipe section are formed to slightly different diameters.

With this technique, it is possible even to shrink the end of the pipe without excessive wrinkling to a diameter less than that of an imaginary cylinder defined by a surface of revolution contacting the innermost surfaces of the pipe. If the pipe is to be shrunk, the best results are obtained if the pipe is rotated about its longitudinal axis after a first compression until portions of the pipe unengaged by the die segments during the first compression are disposed between radially opposed die segments; the die segments can be compressed a second time to complete the operation.

With this technique, it is possible to remove a minimum number of corrugations and yet provide adequate sealing and strength characteristics for connected pipe sections. It is intended that the die segments engage the pipe for a distance measured axially of the pipe approximately equal to the width of only one corrugation. Because virtually all portions of the end portion are engaged simultaneously by radially movable, annularly disposed dies, the resultant end portion is extremely smooth and substantially free of wrinkles or other imperfections. By accurately controlling the movement of the die segments, in turn the diameter of the finished product is controlled accurately, with obvious attendant advantages.

A corrugated pipe having an end section of cylindrical configuration and made in accordance with the invention has tremendous advantages when used as a shell in a composite pile. These advantages are set out more fully in a concurrently filed U.S. patent application Ser. No. 937,337, now Pat. No. 4,252,473, entitled "Composite Pile and Method of Manufacture", which is hereby incorporated by reference. As is stated in the referenced application, the shell is formed of steel, which is typically of 8 to 20 gauge and which has helical corrugations along a major portion of its length.

DESCRIPTION OF THE PREFERRED EMBODIMENT

Figure 1:
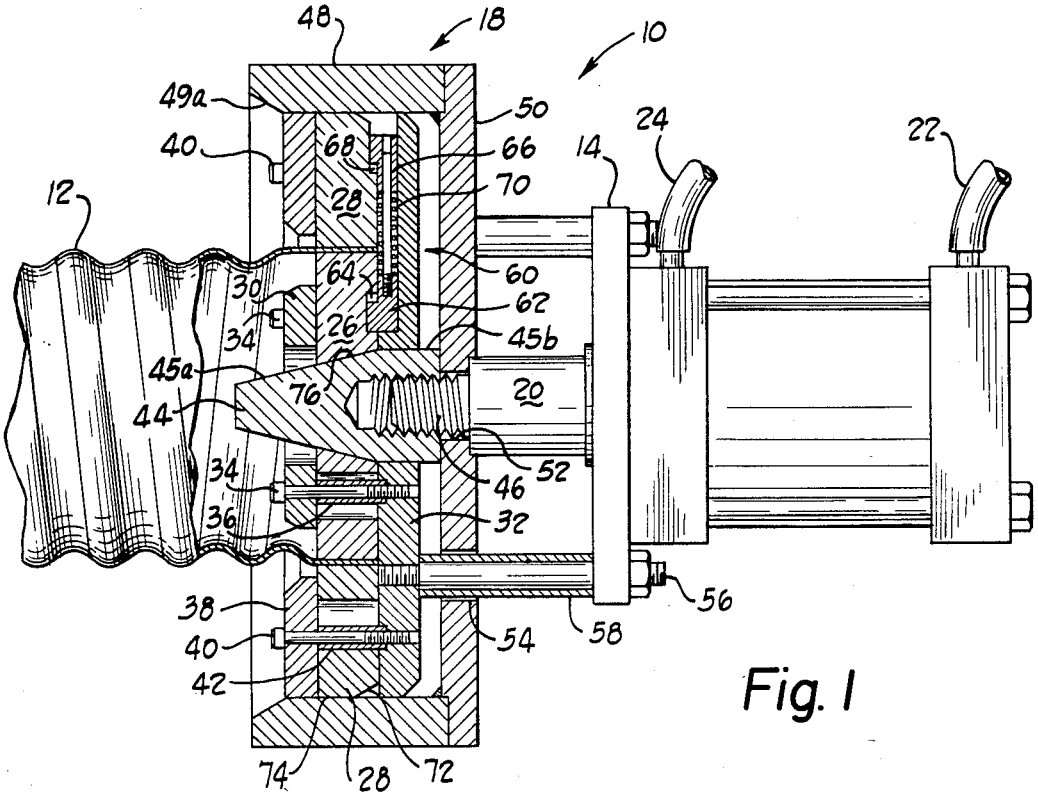
FIG. 1 is an elevational view, partly in section, of a helically corrugated pipe in the process of having an end portion straightened by a machine employing radially movable, annular die segments.
Figure 2:
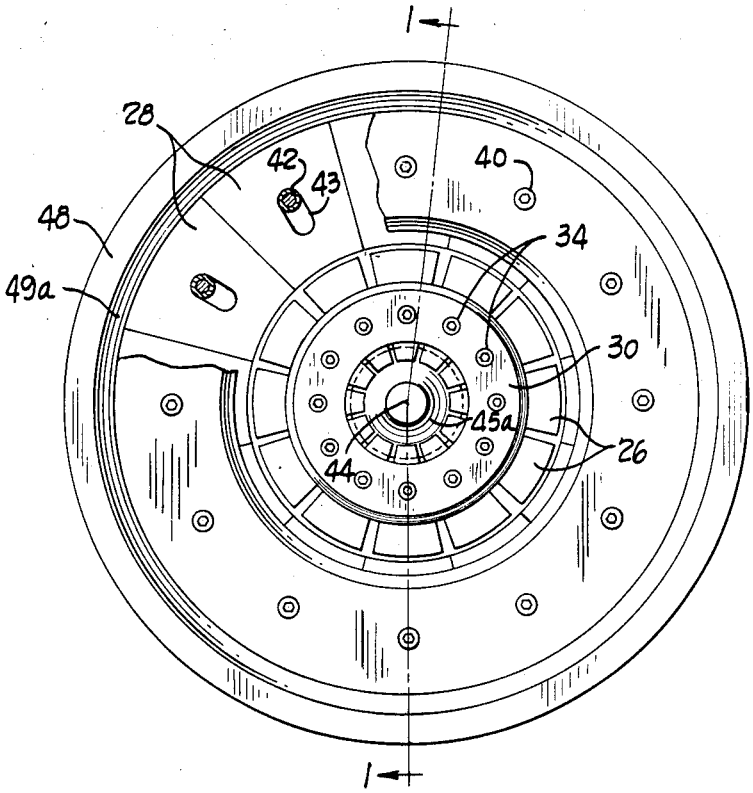
FIG. 2 is an end view of the machine of FIG. 1 showing the die segments in a compressed position.
Figure 6:
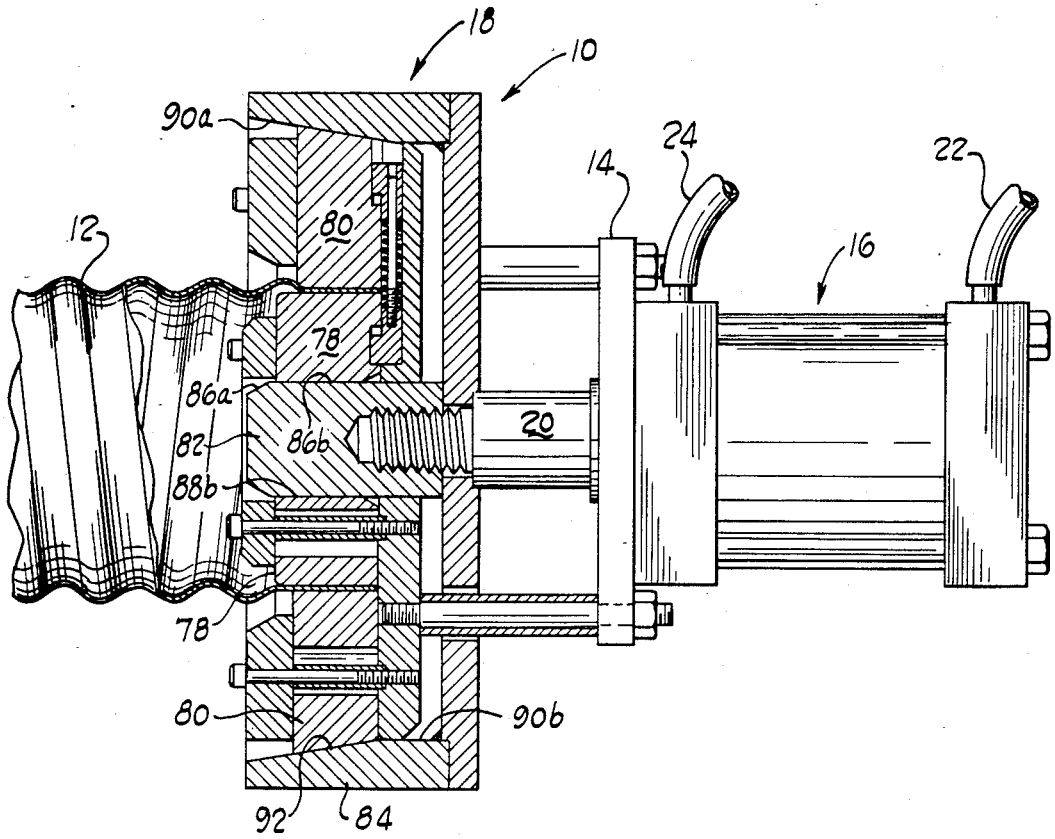
FIG. 6 is a view, partly in section, of a machine which can be used to straighten and shrink end portions of helically corrugated pipe.

A machine 10 capable of straightening end portions of helically corrugated pipe is shown in FIGS. 1, 2, and 6. A commercially available machine 10 suitable for carrying out the invention is manufactured by the Atlanta-Grotnes Machine Co., Inc. of Atlanta, Ga., Model No. T.J.SH-2. In FIGS. 1 and 6, a pipe section 12 is shown with one of its ends 13 positioned in the machine to be acted upon.

The machine includes a support plate 14 to which a hydraulic motor 16 and a compression section 18 are attached. The hydraulic motor 16 includes a double-acting piston (not shown) to which a ram 20 is connected. The ram 20 extends outwardly of the hydraulic cylinder 16 through an opening in the support plate 14 and is connected to the compression section 18. A first hydraulic coupling 22 conveys pressurized hydraulic fluid to act against one face of the piston to advance the ram 20. A second hydraulic coupling 24 conveys pressurized hydraulic fluid to act against the other face of the piston to retract the ram 20.

The compression section 18 includes a plurality of radially movable, annularly disposed, inner die segments 26 and a plurality of radially movable, annularly disposed, outer die segments 28. An equal number of the die segments 26, 28 are provided, and individual ones of the die segments are aligned radially. Opposed surfaces of the die segments 26, 28 in contact with the pipe subtend substantially the same angle.

The inner die segments 26 are constrained against longitudinal movement by a ring 30 secured to a plate-like table 32 by fasteners 34. The spacing between the ring 30 and the table 32 is maintained constant by tubular spacers 36 through which the fasteners 34 extend. The fasteners also extend through radial slots 37 formed in the die segments 26; the slots permit the die segments to move radially.

In like manner, the outer dies 28 are constrained against longitudinal movement by a ring 38 connected to the table 32 by fasteners 40 and spacers 42. Radial slots 43 (see FIG. 2) in the die segments 28 permit the die segments to move radially. The length of the spacers 36, 42 is chosen such that the die segments can move radially without excessive friction and yet the die segments cannot move longitudinally.

The actuating mechanism for the die segments includes an inner cam 44 which, as shown in FIG. 1, includes a conical portion **45*a* and a cylindrical portion 45*b*. The inner cam 44 is secured to a threaded tenon 46 projecting from the ram 20. An outer cam 48 actuates the outer die segments 28. The outer cam 48 consists of a solid of revolution having a beveled inner surface 49*a* and a cylindrical inner surface 49*b*. The outer cam 48 is secured to a disc 50 which, in turn, is connected to the ram 20. In order to make this connection, the disc 50 includes a central aperture 52 permitting the disc to be fitted about the threaded tenon 46 and secured there between the end of the ram and the inner cam 44, upon tightening of the inner cam 44**.

The disc 50 also includes a plurality of annularly disposed openings 54 located approximately radially midway between the center of the disc and its outer edge. Fasteners 56 extend through these openings and connect the table 32 to the support plate 14, thereby attaching the compression section 18 to the hydraulic motor 16. Tubular spacers 58 are disposed about the fasteners 56 and maintain a desired spacing between the support plate 14 and the table 32.

In order to insure that the inner and outer die segments 26, 28 always ride upon the die-actuating surfaces of the inner and outer cams 44, 48, a biasing means 60 is connected between eacch radially aligned pair of die segments. The biasing means includes a block 62 partially disposed within a recess 64 in the back face of each inner die segment and a block 66 partially disposed in a recess 68 in the back face to each outer die segment 28. A spring 70 extends between the blocks 62, 66 to bias the blocks, and hence the die segments, apart.

The timing and extent of die segment movement depends on the configuration of the inner and outer cams 44, 48, as well as on the configuration of the die segment surfaces in contact with the inner and outer cams. The shape of the inner and outer cams already has been discussed. As for the shape of outer die segments 28, the cam-engaging portion of these segments 28 includes a beveled surface 72 disposed closest to the back face of the die segment and an outer surface 74 aligned with the cylindrical inner surface **49*b* of the outer cam 48. The cam-engaging portion of the inner die segments 26 includes a tapered surface 76 aligned with the conical portion 45*a* of the inner cam 44**.

OPERATION

Figure 3:
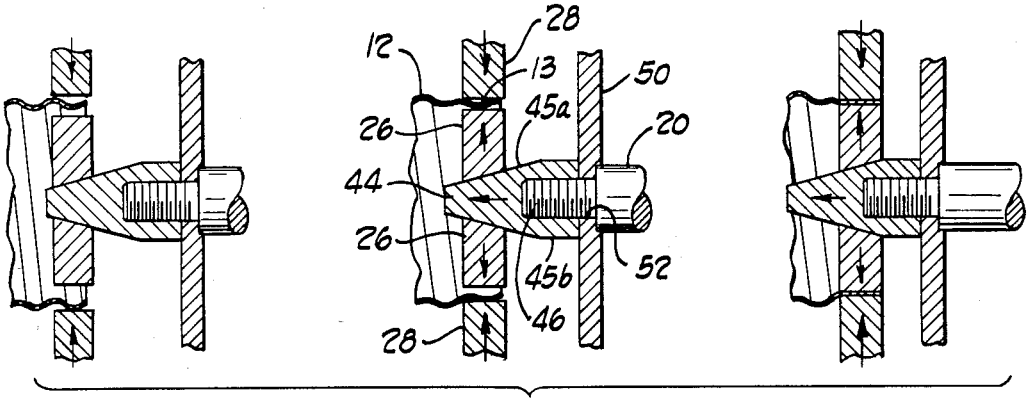
FIG. 3 is a schematic representation of the straightening operation.

When it is desired to straighten an end portion 13 of a pipe section 12, fluid pressure in the first hydraulic coupling 22 is decreased, and fluid pressure in the second hydraulic coupling 24 is increased. This causes the piston, and hence the ram 20, to retract, thereby permitting the die segments to open to their maximum position under the influence of the biasing means 60. The end portion 13 then is disposed between the inner and outer die segments and, upon reversing the fluid pressure supplied to the piston, the ram 20 will be advanced to the left as shown in FIG. 1. During a portion of this ram 20 advancement, beveled surfaces 72 of the outer die segments engage a beveled inner surface **49*a* of outer cam 48. Because of the abruptness of the beveled surfaces 49*a*, 72, the outer die segments 28 will be moved inwardly to a rest position very quickly. Referring now to FIG. 3, due to the comparative gradual taper of the surfaces 45*a*, 76, the inner die segments 26 slowly will be expanded outwardly to compress the end portion 13** between the die segments.

This particular relationship between inner and outer die segment movement is used when it is desired to produce an end portion having a finished diameter greater than that of an imaginary cylinder defined by a surfce of revolution connecting the innermost surfaces of the pipe. The outer die segments 28 will be pushed together tightly so that there will be little or no gap between adjacent outer die segments. Because the inner die segments 26 are being expanded (as shown in FIG. 2), a small gap will exist between adjacent inner die segments in the expanded position.

Figures 4A, 4B:
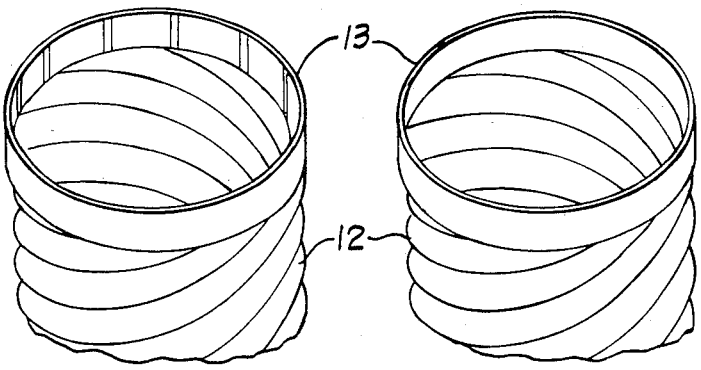
FIG. 4A shows a pipe section having a straightened end portion after a first compression by the die segments.
FIG. 4B is a view of the pipe of FIG. 5A after a second compression by the die segments.

Referring now to FIG. 4A, small, spaced portions on the inner diameter of the end portion will be unengaged by the inner die segments so that die marks may remain after the compressing operation. If it is desired to remove these die marks, pressure on the dies can be released, the pipe section can be rotated about a longitudinal axis so that the unengaged portions of the pipe are disposed between radially aligned die segments, and the compressing operation can be repeated. The pipe should be rotated through less than an angle A, where A is the angle subtended by the surface of individual die segments 26 when the pipe is engaged, and more than an angle B, where $$B = \frac{360^\circ}{\text{(Total number of inner die segments 26)}} - A.$$

By this technique, a pipe having a straightened end portion of uniform wall thickness and accurately controlled diameter is produced.

Figure 5:
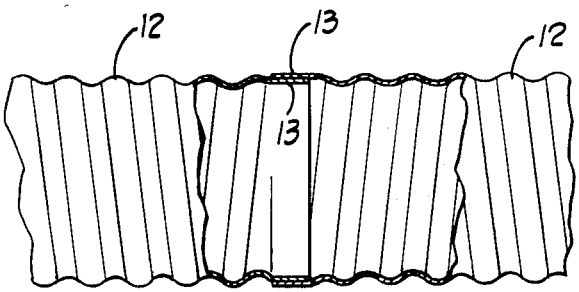
FIG. 5 is an elevational view, partly in section, of telescopically joined pipe sections produced in accordance with the invention.

If it is desired to produce pipe sections which may be connected telescopically, as in FIG. 5, a machine having different die segments or cams can be used to straighten the other end portion of the pipe section to a slightly different diameter than that shown in FIGS. 1–4. Due in part to the accuracy of the straightening operation, it is necessary to straighten only a minimum length of the pipe in order to produce joined pipe sections having adequate sealing and strength characteristics. It has been found that the length of the straightened end portion need be only approximately the width of a single corrugation measured normal to a longitudinal axis of the corrugation. Such a minor amount of pipe deformation means that fewer pipe sections are needed to form a conduit extending a given distance and, consequently, overall expense of the conduit is decreased.

The machine 10 also can be used to shrink the end of helically corrugated pipe. Referring to FIG. 6, the machine has been modified by replacing the inner and outer die segments 26, 28, and the inner and outer cams 44, 48, with substitute inner and outer die segments 78, 80, and substitute inner and outer cams 82, 84. In all other respects, the machine 10 is identical to the machine described previously.

Essentially, the die-actuating surfaces of the cams and the dies themselves are the reverse of the configuration shown in the previously described embodiment. That is, the inner cam 82 includes a rather sharply beveled surface 86*a* and a cylindrical surface 86*b*. The inner die segments 78 include a beveled surface 88*a* disposed close to the back face of the die segment and a surface 88*b* aligned with the cylindrical surface 86*b* of the inner cam. The outer cam 84 includes an inner conical surface 90*a* decreasing in diameter from left to right as viewed in FIG. 6 and a cylindrical inner surface 90*b*. The outer die segments 80 include a surface 92 aligned with the conical surface 90*a* of the outer cam.

It is apparent that the die movement of the machine of FIG. 6 largely is the reverse of the previously described embodiment. That is, upon extension of the ram 20, the surfaces 86*a*, 88*a* quickly expand the inner die segments to a rest position controlled by the diameter of the cylindrical surface 86*b*. After the inner die segments have reached their rest position, the outer cam 84 gradually will compress the outer die segments against the outer surface of the pipe to compress the pipe and thereby shrink the diameter of the end portion.

In the shrinking operation just described, two compressions are required to remove most surface imperfections from the end of the pipe. As in the previously described embodiment, pressure on the die segments is released, the pipe is rotated about a longitudinal axis until unengaged portions of the pipe are disposed between radially aligned die segments, and the die segments are brought together again.

Because it is relatively easy to produce high quality expanded end portions, it is expected that most straigthening operations will involve expansion of the pipe to some extent. Nevertheless, a pipe section having a shrunken, straightened end portion can be useful for various purposes. For example, in constructing a composite pile, it is desirable to drive the end of a helically corrugated pipe into the end of a wooden section. By employing a pipe section having a shrunken end portion, a larger-diameter pipe section can be employed with a smaller wooden section than heretofore possible, with the result that (a) the pipe can be driven into the wooden section with comparative ease, and (b) the entire composite pile can be driven into the ground with less effort.

Although the invention has been described with a certain degree of particularly, it will be appreciated that the present disclosure of the preferred embodiment has been made only by way of example. Various changes in the details of construction and operation may be resorted to without departing from the true spirit and scope of the invention, and it is intended to cover all such changes in the appended claims.

What is claimed is:

1. A method for re-forming an end portion of a pipe having helical corrugations, comprising:

(a) placing the end portion between inner and outer annular dies each having a plurality of segments;

(b) moving opposed die segments radially toward each other to apply a force to the pipe to squeeze the pipe between the opposed die segments including moving the inner die segments radially to a rest position before the outer die segments have completed their radially inward movement; and (c) the rest position of the inner die segments being such that the resultant inner diameter of the reformed end portion is no greater than the diameter of an imaginary surface of revolution defined by the innermost surface of the pipe;

(d) whereby the force application removes the helical corrugations of the end portion of the pipe.

2. The method of claim 1, comprising the additional steps of:

(a) moving at least some of the opposed die segments radially away from others so that there is a sufficient clearance between the opposed segments to permit the end portion to be moved;

(b) rotating the pipe about a longitudinal axis so that any parts of the end portion not previously contacted by both inner and outer die segments now are disposed between opposed die segments; and (c) reapplying force to the die segments so that the end portion of the pipe is squeezed again between opposed die segments.

3. The method of claim 1, wherein the die segments extend axially of the pipe a length X, where X is approximately the width of one corrugation.

4. The method of claim 1, comprising the additional steps of:

(a) moving at least some of the opposed die segments radially away from others so that there is a sufficient clearance between the opposed segments to permit the end portion to be moved;

(b) rotating the pipe about a longitudinal axis a rotational amount different the circumferential extend of a die segment or a multiple thereof so that each part of the end portions previously between or at the juncture of two die segments is now disposed between opposed die segments; and (c) reapplying force to the die segments so that the end portion of the pipe is squeezed again between opposed die segments.

5. A method for reforming an end portion of a pipe having corrugations, comprising:

(a) disposing the end portion between inner and outer dies, each having a plurality of segments;

(b) moving the inner die segments radially outwardly to a diameter no greater than the diameter of an imaginary surface of revolution defined by the innermost surfaces of the pipe;

(c) moving the outer die segments radially inwardly to contact the outer surface of the pipe and to apply a radially inward force to the pipe maintaining the inner die segments stationary to resist the radial force imparted to the pipe by the outer die segments;

(d) continuing movement of the outer die segments until they are brought sufficiently close to the inner die segments that the helical corrugation of the end portion are removed;

(e) moving the segments of at least one of the dies in an opposite direction to space the segments from the re-formed end portion; and (f) removing the pipe from between the dies.

6. The process of claim 5 wherein the pipe being reformed is steel of the order of 20 gauge or thicker.

7. A method for re-forming an end portion of a pipe having corrugations, comprising:

(a) disposing the end portion between inner and outer dies, each having an equal number of segments, individual segments being aligned radially and the opposed surfaces of radially aligned segments subtending substantially the same angle;

(b) moving the inner die segments radially outwardly to a diameter no greater than the diameter of an imaginary surface of revolution defined by the innermost surfaces of the pipe;

(c) moving the outer die segments radially inwardly to contact the outer surface of the pipe and to apply a radially inward force to the pipe while maintaining the inner die segments stationary to resist the radial force imparted to the pipe by the outer die segments;

(d) continuing movement of the outer die segments until they are brought sufficiently close to the inner die segments that the helical corrugations of the end portion are removed;

(e) moving the segments of at least one of the dies in an opposite direction to space the segments from the re-formed end portion; and (f) removing the pipe from between the dies.

8. The method of claim 7, comprising the additional steps of:

(a) rotating the pipe about a longitudinal axis through other than an angle A or a multiple thereof, where A is the angle subtended by the surface of individual die segments which engage the pipe, and (b) repeating steps (a) through (f).

9. The process of claim 7 wherein the pipe being reformed is steel of the order of 20 gauge or thicker.

10. A method for removing certain of the corrugation, from helically corrugated pipe to produce a reformed end portion of uniform wall thickness, accurately controlled diameter, and an axial extent equal to X, where X is approximately the width of one corrugation, comprising:

(a) placing the end portion between a number of inner and outer die segments having an axial extent at least equal to X, individual ones of the die segments being aligned radially and opposed surfaces of the die segments subtending substantially the same angle, the outer die segments being capable of applying a radially inward force to the pipe the inner die segments being capable of resisting the radial force imparted to the pipe by the outer die segments;

(b) securing the die segments against movement longitudinally of the pipe;

(c) engaging the inner die segments with a first, longitudinally movable cam means for applying radially outward force to the inner die segments;

(d) continuing longitudinal movement of the first cam means until the inner die segments are extended outwardly to a diameter no greater than the diameter of an imaginary surface of revolution defined by the innermost surfaces of the pipe;

(e) engaging the outer die segments with a second, longitudinally movable cam means for applying radially inward force to the outer die segments;

(f) continuing longitudinal movement of the second cam means until the outer die segments engage the outer surface of the pipe and the outer die segments are brought sufficiently close to the inner die segments that helical corrugations in the end portion are substantially removed;

(g) retracting the first and second cam means longitudinally so that radial force on the pipe imparted by the die segments is lessened sufficiently to permit the end portion to be moved;

(h) rotating the pipe about a longitudinal axis through other than an angle A, where A is the angle subtended by the surfaces of the individual inner die segments when the pipe is engaged (i) repeating steps (a) through (g); and (j) removing the now re-formed end portion from between the inner and outer die segments.

11. The process of claim 10 wherein the pipe being reformed is steel of the order of 20 gauge or thicker.

* * * * *